US008761616B2

(12) United States Patent
Hotogi

(10) Patent No.: US 8,761,616 B2
(45) Date of Patent: Jun. 24, 2014

(54) METHOD FOR DETECTING OPENING/CLOSED STATE OF AN INTERLOCK SWITCH PROVIDED IN AN ELECTRONIC DEVICE

(75) Inventor: Tatsuya Hotogi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 455 days.

(21) Appl. No.: 13/112,929

(22) Filed: May 20, 2011

(65) Prior Publication Data

US 2011/0311237 A1 Dec. 22, 2011

(30) Foreign Application Priority Data

Jun. 18, 2010 (JP) ..... 2010-139943
May 12, 2011 (JP) ..... 2011-107639

(51) Int. Cl.
*G03G 15/00* (2006.01)

(52) U.S. Cl.
USPC ..... 399/9; 399/90

(58) Field of Classification Search
USPC ..... 399/9, 90, 114, 88, 37, 13
See application file for complete search history.

(56) References Cited

U.S. PATENT DOCUMENTS

2011/0076046 A1* 3/2011 Oh ..... 399/88

FOREIGN PATENT DOCUMENTS

| | | |
|---|---|---|
| JP | 2006-159740 | 6/2006 |
| JP | 2006-297812 | 11/2006 |
| JP | 2009-42376 | 2/2009 |
| JP | 2010-214620 | 9/2010 |

OTHER PUBLICATIONS

Machine English Translation of JP2006-297812 published on Nov. 2, 2006.*
Machine English Translation of JP2009-042376 published on Feb. 26, 2009.*

* cited by examiner

*Primary Examiner* — Billy Lactaoen
(74) *Attorney, Agent, or Firm* — Fitzpatrick, Cella, Harper & Scinto

(57) ABSTRACT

A controller determines a state of a switch unit based on a potential difference between a power supply side and a load side of the switch unit. Alternatively, when an electronic device is in a first operating state, the controller determines a state of the switch based on a result of a first detection unit. When the electronic device is in a second operating state that a power consumption of the device is lower than that in the first operating state, the controller determines the state of the switch based on a result of a second detection unit.

22 Claims, 5 Drawing Sheets

METHOD FOR DETECTING OPENING/CLOSED STATE OF AN INTERLOCK SWITCH PROVIDED IN AN ELECTRONIC DEVICE

BACKGROUND OF THE INVENTION

1. Field of the Invention

The present invention relates to an electronic device, such as an image forming apparatus, and in particular to technology for detecting an open/closed state of an interlock switch thereof.

2. Description of the Related Art

Image forming apparatuses such as copiers or printers, which are electronic devices, are provided with an opening/closing cover by which a service operator can access the inside of the apparatus. Opening the cover, the service operator can execute a maintenance operation, such as exchanging consumable parts. Besides exchanging consumable parts, also when a malfunction occurs, for example when conveyance failure of paper occurs (also referred to as "jam"), the user may open the cover to retrieve the sheet that has caused the jam. There are also image forming apparatuses, in which a driving system, such as a motor and gears for driving a conveying system, is exposed when the cover is opened. Similarly, there are also image forming apparatuses, in which an electrode under high voltage is exposed when the consumable part has been retrieved. Japanese Patent Laid-Open No. 2006-297812 proposes a mechanical switch mechanism (interlock switch), that cuts off the voltage supplied to the driving system or a high-voltage current source, when the cover is opened.

SUMMARY OF THE INVENTION

The invention disclosed in Japanese Patent Laid-Open No. 2006-297812 is well thought-out with regards to the aspect that the supply of power can be cut off when detecting opening/closing of the cover, but it still leaves room for improvement. For example, in order to achieve a lower energy consumption of the image forming apparatus, a power saving mode is necessary, where the energy consumption is lowered in an inoperative state. The power saving mode lowers the clock oscillation frequency of a microcontroller or stops the clock oscillation operation. In such a case, there is a risk that the microcontroller cannot detect the open state of the interlock switch.

Accordingly, the present invention is to solve at least one of the above-described and other problems. More specifically, it is a feature thereof that it can detect the open/closed state of a cover independently from a voltage value that is applied to the switch unit or a clock oscillation state of a control circuit controlling the electronic device. The other problems should become clear from the overall specification.

An electronic device includes a switch unit that opens or closes interlocking with an opening or closing operation of a cover that the electronic device is provided with for servicing its inside; a voltage converter that generates a first output voltage and a second output voltage with different voltage values by stepping down a voltage that is supplied from a commercial alternate current power supply; a load to which the first output voltage that is output from the voltage converter is supplied via the switch unit; and a controller to which the second output voltage that is output from the voltage converter is supplied and that controls the electronic device. To solve the above-noted problems, the electronic device may further include a potential difference detection unit that detects a potential difference between a power supply side and a load side of the switch unit, wherein the controller determines a state of the switch unit based on the potential difference. Alternatively, the electronic device may further include a first detection unit that detects a voltage on the load side of the switch unit, and a second detection unit that detects a voltage on the load side of the switch unit. When the electronic device is in a first operating state, the controller determines a state of the switch unit based on a result of the first detection unit. When the electronic device is in a second operating state that a power consumption of the device is lower than that in the first operating state, the controller determines the state of the switch unit based on a result of the second detection unit.

Further features of the present invention will become apparent from the following description of exemplary embodiments (with reference to the attached drawings).

DESCRIPTION OF THE EMBODIMENTS

Related Art

Image forming apparatuses are examples of electronic devices that can ordinarily assume a plurality of operating states (for example: a printing state, an standby state, a power saving state, and the like). The energy that is consumed by the entire image forming apparatus in the power saving state is set to be lower than the energy that is consumed by the entire image forming apparatus in the standby state. The reason for this is that in the standby state, the various parts of the image forming apparatus are readied to immediately start image forming. For example, current is supplied to the heater of the fixing device, so that it assumes a predetermined temperature. The printing state is a state in which images are actually formed on a recording medium, and more energy is consumed than in any of the other states.

As described above, it is necessary than in both the standby state (including the printing state) and the power saving state of the image forming apparatus, the open/closed state of an interlock switch is detected by the microcontroller controlling the image forming apparatus. The reasons for this are as follows:

if the cover is opened in the printing state, in order to stop the printing operation, if the cover is opened in the power saving state, in order to transition from the power saving state to the standby state, if the cover is closed, in order to confirm whether any consumable part has been exchanged and to perform a preprocessing control for the exchanged consumable parts.

Figure 4A:
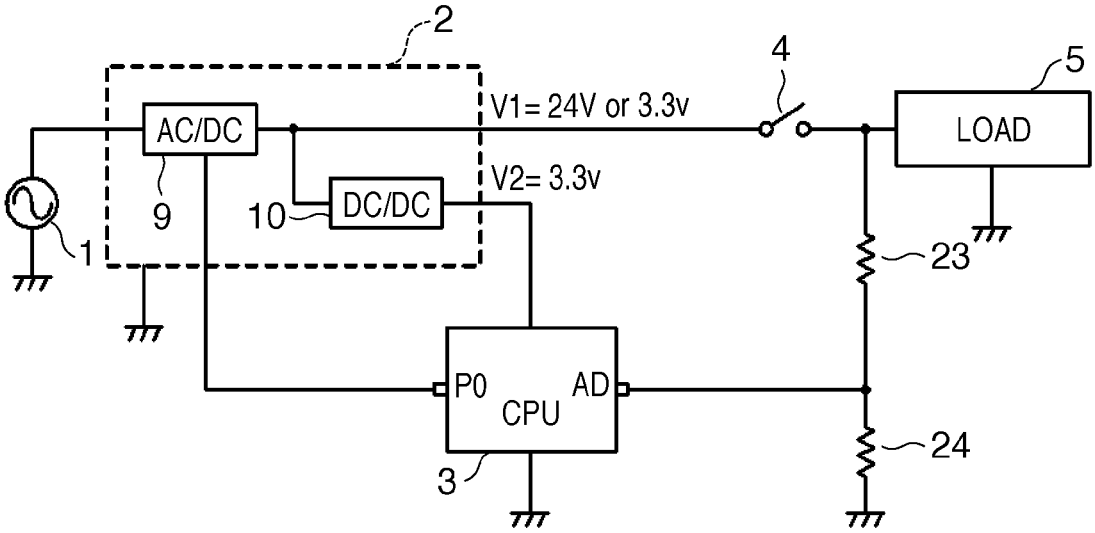
FIG. 4A is a diagram outlining a configuration for detecting whether an interlock switch is open or closed according to the related art.

As a procedure for detecting the open/closed state of the interlock switch, it is most convenient to detect the voltage on a load side (downstream side) of the interlock switch. In FIG. 4A, a power supply system is provided with a low-voltage power supply 2 that generates a DC output voltage V1 with an AC/DC converter 9 from a commercial alternate current power supply 1, and generates a DC output voltage V2 from the output voltage V1 with a DC/DC converter 10. The low-voltage power supply 2 is an example of a voltage converter that generates a first output voltage and a second output voltage having different values, by stepping down a voltage supplied from a commercial alternate current power supply. The DC output voltage V1 is supplied via an interlock switch 4 to a drive system or a high-voltage power supply, for example. The interlock switch 4 is an example of a switch unit that opens or closes as a result of an opening or closing operation of the cover provided for servicing the inside of the electronic device. Here, the driving system or high-voltage power supply or the like is indicated as a load 5 to be protected in accordance with an opening or closing operation of the cover. The load 5 is an example of a load to which a first output voltage that is output from the voltage converter is supplied via a switch unit. The DC output voltage V2 is supplied to a control circuit including the microcontroller 3, such as a CPU. The microcontroller 3 is an example of a controller to which the second output voltage that is output from the voltage converter is supplied and that controls the electronic device.

It is assumed that in the standby state, voltage values of about V1=24V and V2=3.3V are used. In the power saving state, the microcontroller 3 sends out a status transition signal from a digital output port PO to the AC/DC converter 10. This is in order to attain a low energy consumption. Upon transition to the power saving state, the output voltage V1 of the AC/DC converter is stepped down to a voltage value that is close to V2. The DC/DC converter 10 outputs the voltage V1 that is input into it unchanged. That is to say, in the power saving state, V1=V2=3.3V.

The voltage on the load side of the interlock switch 4 is divided by resistors 23, 24, and input into an analog/digital input port AD of the microcontroller 3. The analog/digital input port AD is a port incorporating an analog/digital converter. If the interlock switch 4 is open, the voltage on the load side of the interlock switch 4 is 0V. Thus, also the input voltage of the analog/digital input port AD becomes 0V. On the other hand, if the interlock switch 4 is closed, the voltage on the load side of the interlock switch 4 becomes V1. As noted above, V1 can take on the voltage values 24V or 3.3V. Regardless whether it is 24V or 3.3V, if the ratio of the resistors 23 and 24 is suitably set, the microcontroller 3 can detect the open/closed state of the interlock switch 4 in accordance with the voltage value that is input into the analog/digital input port AD.

Figure 4B:
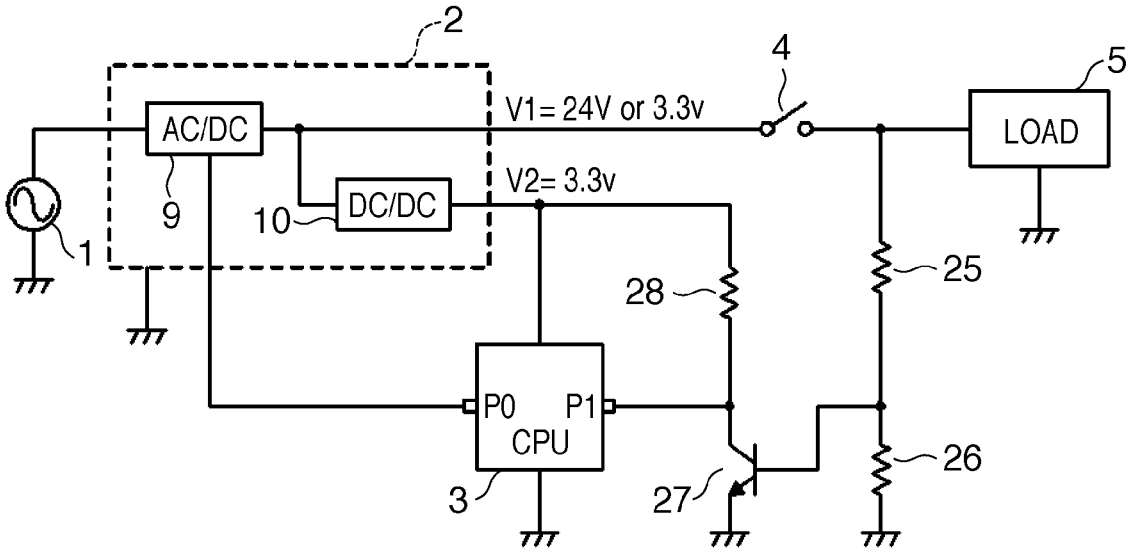
FIG. 4B is a diagram outlining a configuration for detecting whether an interlock switch is open or closed according to the related art.

The aspect where FIG. 4B differs from FIG. 4A is that the voltage division circuit made up of the resistors 23 and 24 is replaced by a voltage conversion circuit including voltage dividing resistors 25, 26, an NPN transistor 27 and a pull-up resistor 28. If the interlock switch 4 is open, the NPN transistor 27 is turned off, and the digital input port PI of the microcontroller 3 senses "High". If, on the other hand, the interlock switch 4 is closed, then the voltage on the load side of the interlock switch 4 becomes V1. As noted above, V1 can take on the voltage values 24V or 3.3V. In both of these cases, the voltage between the base and the emitter of the NPN transistor 27 is about 0.7V. Thus, the NPN transistor 27 is turned on. That is to say, the digital input port PI senses "Low". Thus, even without providing an analog/digital input port A/D, it is possible to detect the open/closed state of the interlock switch 4 with a microcontroller 3 that is not provided with a digital input port PI.

Now, to accomplish a lower energy consumption, it may occur that the clock oscillation frequency of the microcontroller 3 is lowered in the power saving state. Moreover, in order to accomplish even further energy savings, it may also occur that the clock oscillation operation is stopped in the power saving state. When the clock oscillation operation is stopped, then it is necessary that the open state of the interlock switch 4 is detected by an interrupt input function of the microcontroller 3, the clock oscillation operation is released, and a transition to the standby state is made. If such a control is used, the microcontroller 3 has to use an interrupt input port, which is one type of digital input port. However, in cases where an interrupt input port is used, the following problem may occur.

In the circuit configuration illustrated in FIG. 4A, it is conceivable that the analog/digital input port AD of the microcontroller 3 is replaced by an interrupt input port. An interrupt input port digitally detects the voltage that is input into it. Thus, a state may occur in which the open/closed state of the interlock switch 4 cannot be detected. For example, if the interlock switch 4 is closed and V1=3.3V in the power saving state, then the voltage that is input into the interrupt input port by voltage division with the resistors 23, 24 becomes "Low". On the other hand, also if the interlock switch 4 is open, the voltage that is input into the interrupt input port becomes "Low". Consequently, in the power saving state, it is not possible to detect the closed state of the interlock switch 4.

In the circuit configuration illustrated in FIG. 4B, it is conceivable to replace the digital input port PI of the microcontroller 3 with an interrupt input port. In this case, with regard to the detection level of the input port, there is no difference between the hardware function of the digital input port PI and the interrupt input port. Thus, as explained above, it is possible to detect the open/closed state of the interlock switch 4. However, this circuit detects the open/closed state of the interlock switch 4 by determining whether the voltage between the base and the emitter of the NPN transistor 27 is about 0.7V or not. Therefore, time may be needed to detect in particular the open state. Generally, an electrolytic capacitor for voltage smoothing is often mounted as the load 5. In the standby state and in particular in the printing state, if the interlock switch 4 is opened, the voltage with which this electrolytic capacitor is charged drops due to the time constant. That is to say, when V1=24V and the cover is opened, time is necessary in order to lower the voltage applied between the base and the emitter of the NPN transistor 27 to about 0.7V. If time is necessary to detect that the cover is in the open state, then, taking the detection of the open state of the interlock switch 4 as a trigger, a laser scanner (not shown in the drawings) that is supposed to be stopped may continue to operate for a certain time, even though the cover is in the open state.

Accordingly, in the embodiment explained below, it is possible to detect the open/closed state of the interlock switch 4 immediately, independently from the voltage value that is applied to the interlock switch 4 and from the clock oscillation state of the microcontroller 3 that controls the electronic device.

Embodiment 1

Figure 1A:
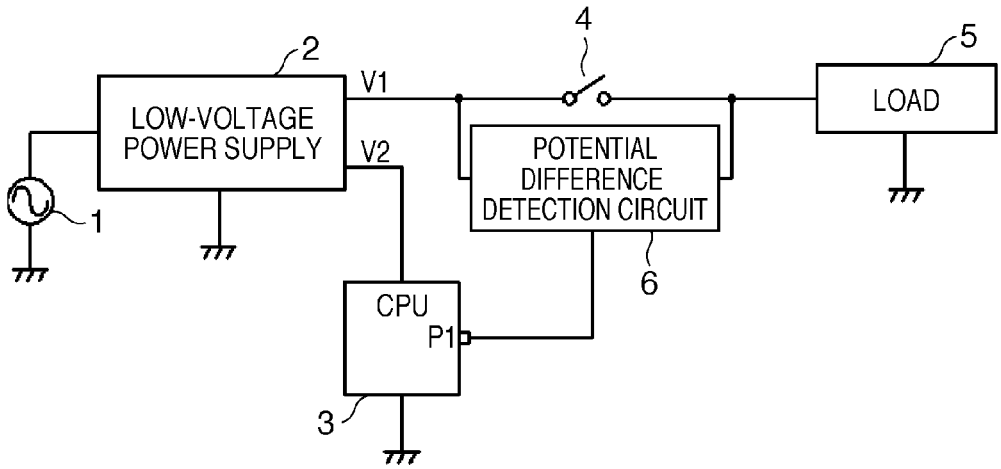
FIG. 1A is a diagram outlining a configuration for detecting whether an interlock switch is open or closed according to Embodiment 1 and Embodiment 2.

Embodiment 1 is explained using FIG. 1, but these explanations are simplified by attaching the same reference numerals for components that already have been explained. A characteristic feature in FIG. 1A is that the open/closed state of the interlock switch 4 is detected by a potential difference detection circuit 6 that detects a potential difference between an upstream side (power supply side) and a downstream side (load side) of the interlock switch 4.

Figure 1B:
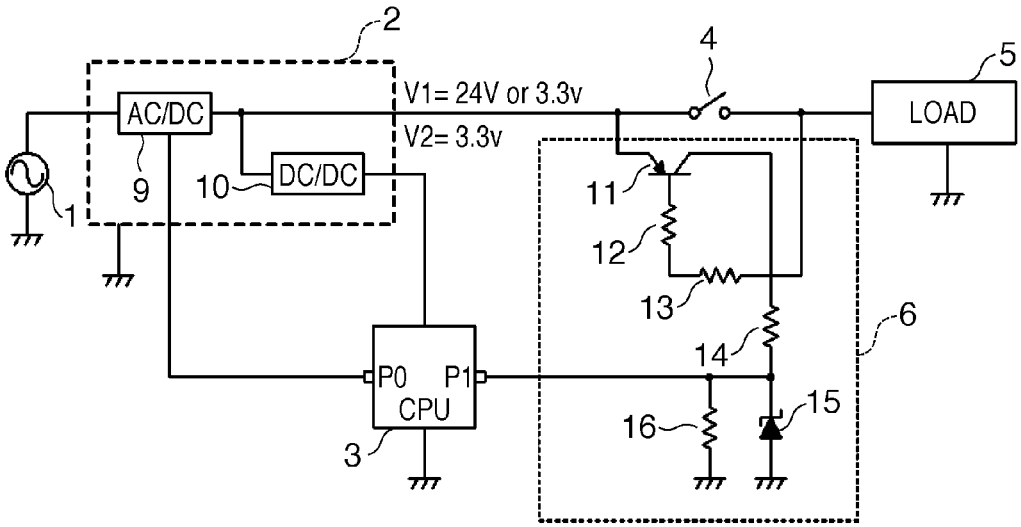
FIG. 1B is a diagram outlining a configuration for detecting whether an interlock switch is open or closed according to Embodiment 1.

A specific configuration example of the potential difference detection circuit 6 is explained using FIG. 1B. In FIG. 1B, the potential difference detection circuit 6 includes a PNP transistor 11, resistors 12, 13, 14, 16, and a constant voltage diode 15. The PNP transistor 11 is an example of a semiconductor switching element having a first terminal, a second terminal and a third terminal. When the voltage difference between the first terminal and the second terminal exceeds a predetermined value, then a predetermined output voltage is present at the collector terminal, which is the third terminal. The emitter terminal of the PNP transistor 11, which is the first terminal, is coupled to the power supply side of the interlock switch 4. The load side of the interlock switch 4 is coupled via the resistors 12 and 13 to the base terminal of the PNP transistor 11, which is the second terminal. The collector voltage of the PNP transistor is divided by a voltage division circuit constituted by the resistor 14 and the constant voltage diode 15. This voltage division circuit is an example of a voltage division portion that includes a first resistor and the constant voltage diode coupled in series, where the output voltage that is output from the third terminal is divided by the first resistor and the constant voltage diode, and the divided voltage is output as the output voltage from the potential difference detection unit to an input port of the controller. The divided voltage that is output from the voltage division circuit is input into the interrupt input port PI (digital input port) of the microcontroller 3.

If the interlock switch 4 is open, then there is a potential difference of at least about 0.7V between the base and the emitter of the PNP transistor 11. For this reason, the PNP transistor 11 is turned on. Then, the output voltage V1 of the power supply side of the interlock switch 4 is converted by the voltage division circuit constituted by the resistor 14 and the constant voltage diode 15 into 3.0V, for example. Thus, the interrupt input port PI detects "High". Thus, the microcontroller 3 functions as a controller that determines that the switch unit is open if the output voltage of the potential difference detection circuit 6 is greater than or equal to a predetermined value. If the output voltage of the potential difference detection circuit 6 is neither greater than nor equal to a predetermined value, then the microcontroller 3 functions as a controller that determines that the switch unit is closed. When a voltage of at least a predetermined value is applied to it, the interrupt input port PI of the microcontroller 3 determines "High", and when a voltage of at least a predetermined value is not applied to it, the interrupt input port PI of the microcontroller 3 determines "Low".

On the other hand, if the interlock switch 4 is closed, there is no meaningful potential difference between the base and the emitter of the PNP transistor 11. Therefore, the PNP transistor 11 is turned off.

Then, the interrupt input port PI detects "Low" due to the pull-down resistor 16. The pull-down resistor 16 is an example of a second resistor that is inserted parallel to the constant voltage diode and the controller.

The potential difference detection circuit 6 is established regardless whether the voltage value of the output voltage V1 is 24V or 3.3V. Furthermore, the voltage detected by it can be processed digitally by the microcontroller 3 using the interrupt input port PI. That is to say, in the power saving state, the microcontroller 3 lowers the output voltage V1 to 3.3V, and lowers the clock oscillation frequency of the microcontroller 3 or stops the clock oscillation operation, thereby saving energy consumed by the electronic device.

There is a further advantage to detecting the potential difference between the base and the emitter of the PNP transistor 11. Namely, when the output voltage V1=24V, then even when the cover is opened, there is hardly any influence by the time constant of the electrolytic capacitor mounted to the load 5. Compared to the circuit illustrated in FIG. 4A, the time until a voltage of about 0.7V is reached, which is necessary for turning the PNP transistor 11 on, can be considerably shortened.

It should be noted that the PNP transistor 11 may be destroyed by a short-circuit between its base and emitter. However, the voltage supply to the load 5 is lowered by connecting the resistors 12 and 13 in series, so that destruction by short-circuiting is suppressed. Thus, the base terminal, which is the second terminal, is coupled via the resistors 12, 13, which are a plurality of resistors, to the load side of the switch unit.

When the power of the image forming apparatus is turned on, the voltage that is supplied from the low-voltage power supply 2 may be unstable. This may lead to an erroneous open/close detection of the interlock switch 4 and the cover. To address this, the microcontroller 3 may skip, stop or delay the open/close detection of the interlock switch 4 until the voltage supplied from the low-voltage power supply 2 is stabilized. Thus, it is possible to reduce erroneous open/close detections of the interlock switch 4 and the cover when turning on the power of the image forming apparatus.

With this Embodiment 1, a configuration is employed, in which a potential difference between the power supply side and the load side of the interlock switch 4 is detected by a potential difference detection unit. Thus, it is possible to detect the open/closed state of the interlock switch 4 independently from the value of the voltage applied to the interlock switch 4 and from the clock oscillation state of the microcontroller 3 controlling the image forming apparatus.

Embodiment 2

Figure 2:
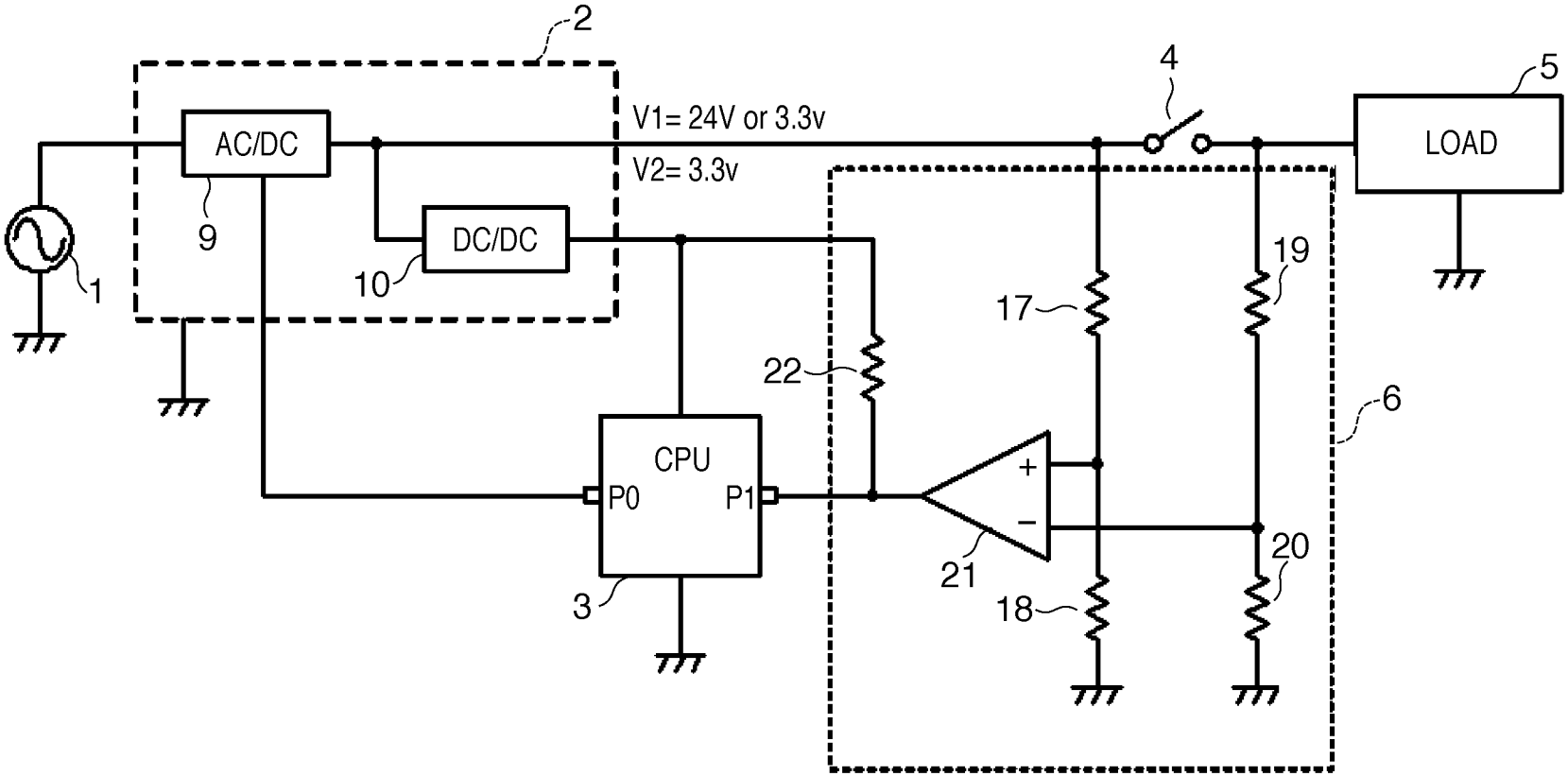
FIG. 2 is a diagram outlining a configuration for detecting whether an interlock switch is open or closed according to Embodiment 2.

Embodiment 2 is explained using FIG. 2. Embodiment 2 relates to another configuration example of the potential difference detection circuit 6. In FIG. 2, the potential difference detection circuit 6 includes a comparator 21, and resistors 17, 18, 19, 20 and 22. The resistors 17 and 18 form a first voltage division portion that divides a power supply side voltage of the switch unit. The resistors 19 and 20 form a second voltage division portion that divides a load side voltage of the switch unit. Moreover, the comparator 21 is a comparator that compares the divided voltage from the first voltage division portion with the divided voltage from the second voltage division portion and outputs a comparison result as an output voltage from the potential difference detection unit into the input portion of the controller.

As shown in FIG. 2, the voltage on the power supply side of the interlock switch 4 is divided by the resistors 17 and 18, and is input into the non-inverting input terminal V+ of the comparator 21. And the voltage on the load side of the interlock switch 4 is divided by the resistors 19 and 20, and is input into the inverting input terminal V− of the comparator 21. When V+>V−, then the comparator 21 sets its output terminal to the open state. On the other hand, when V+<V−, then the comparator 21 sets its output terminal to "Low". The output terminal of the comparator 21 is pulled up by the resistor 22 and is coupled to the interrupt input port PI (digital input port) of the microcontroller 3. The resistance values of the resistors 17, 18, 19, 20 are selected such that if the interlock switch 4 is opened, then V+ becomes greater than V−, and if the interlock switch 4 is closed, then V+ becomes smaller than V−.

Thus, the interrupt input port PI detects that the interlock switch 4 is open if the output voltage of the potential difference detection circuit 6 is "High", and detects that the interlock switch 4 is closed if the output voltage of the potential difference detection circuit 6 is "Low". When the circuit configuration in FIG. 2 is employed, then the open/closed state of the interlock switch 4 can be detected regardless of whether the voltage value taken on by V1 is 24V or 3.3V. Furthermore, there is the advantage that an interrupt input port PI can be employed as an input port provided in the microcontroller 3 in order to input the output voltage of the potential difference detection circuit 6, instead of using an analog/digital input portion AD. That is to say, Embodiment 2 displays the same effect as Embodiment 1.

With Embodiment 2, a circuit configuration is employed that detects the potential difference between the power supply side and the load side of the interlock switch 4 with a potential difference detection circuit 6 using a comparator circuit or the like. Thus, the open/closed state of the interlock switch 4 can be immediately detected independently from the voltage value applied to the interlock circuit 4 and from the clock oscillation state of the microcontroller 3 that controls the electronic device.

Embodiment 3

Figure 3A:
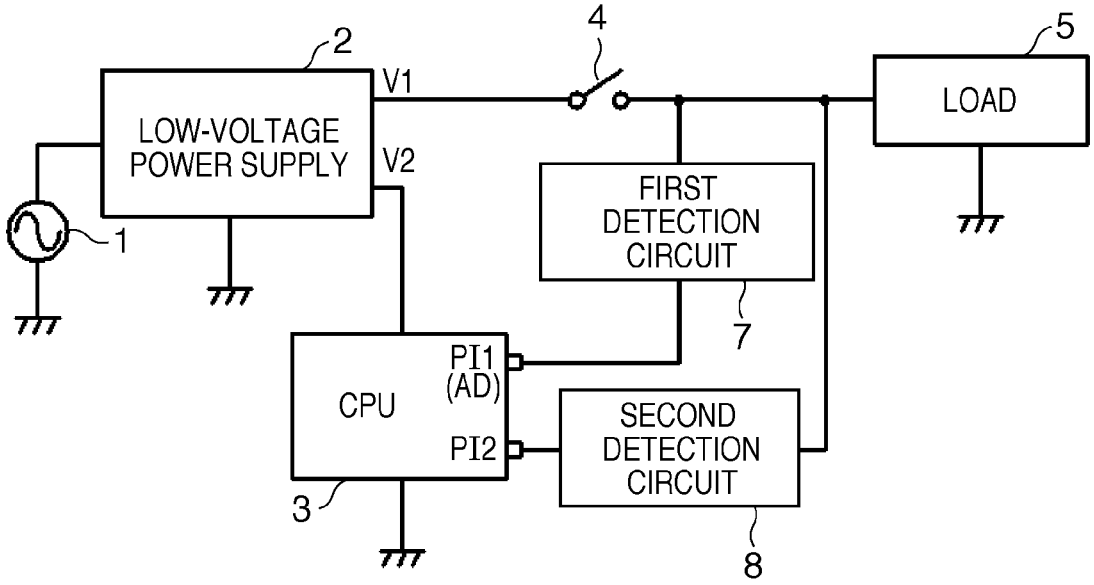
FIG. 3A is a diagram outlining a configuration for detecting whether an interlock switch is open or closed according to Embodiment 3.

Embodiment 3 relates to another configuration example of an open/closed circuit of the interlock switch 4. As shown in FIG. 3A, Embodiment 3 is characterized in that a plurality of voltage detection units are provided. A first detection circuit 7 detects the voltage on the load side of the interlock switch 4. The second detection circuit 8 detects the voltage on the load side of the interlock switch 4. When the electronic device transitions to the standby state, the microcontroller 3 functions as a controller that determines that the switch unit is open if the output voltage of the first detection unit is at least a predetermined voltage, and that determines that the switch unit is closed if the output voltage of the first detection unit is not at least a predetermined voltage. And when the electronic device transitions to the power saving state, the microcontroller 3 functions as a controller that determines that the switch unit is open if the output voltage of the second detection unit is at least a predetermined voltage. Furthermore, when the electronic device transitions to the power saving state, the microcontroller 3 functions as a controller that determines that the switch unit is closed if the output voltage of the second detection unit is not at least a predetermined voltage.

Figure 3B:
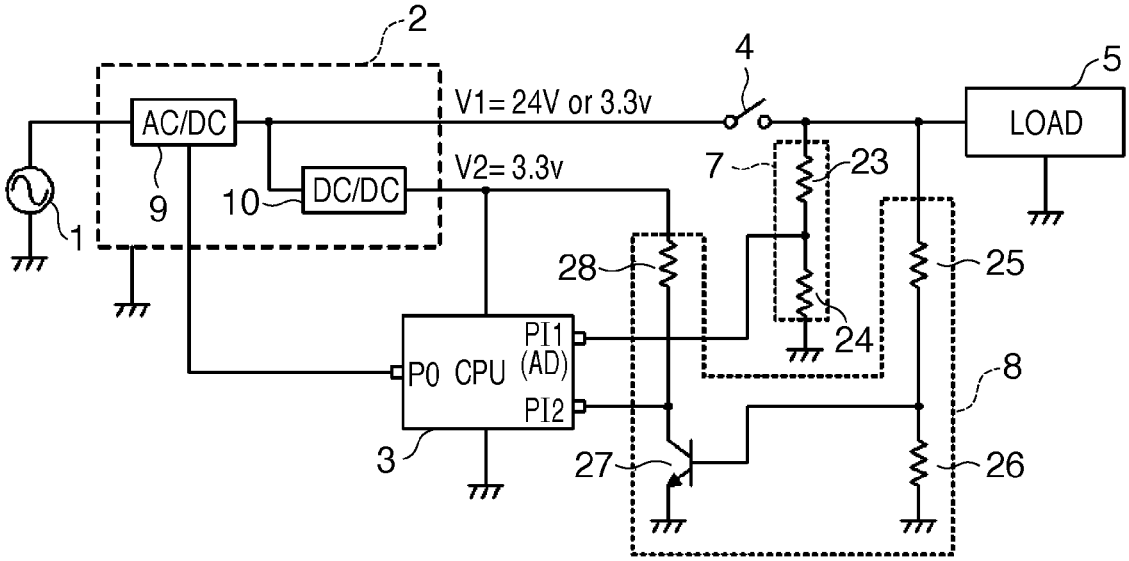
FIG. 3B is a diagram outlining a configuration for detecting whether an interlock switch is open or closed according to Embodiment 3.

As shown in FIG. 3B, the first detection circuit 7 may be configured by a voltage division circuit including the resistors 23 and 24 explained with respect to FIG. 4A. That is to say, the resistors 23 and 24 form a first voltage division portion that divides the voltage on the load side of the switch unit. The voltage on the load side of the interlock switch 4 is divided by the resistors 23 and 24, and is input into a digital input port PI1 of the microcontroller 3. As shown in FIG. 3B, the second detection circuit 8 can be configured by a voltage division portion made of the resistors 25 and 26, an NPN transistor 27, and a pull-up resistor 28, as explained with FIG. 4B. The voltage on the load side of the interlock switch 4 is input via this voltage converter into an interrupt input port PI2 (digital input port) of the microcontroller.

The microcontroller 3 detects the voltage on the load side using the first detection circuit 7 when the electronic device in the standby state, and using the second detection circuit 8 when the electronic device is in the power saving state. As explained with regard to the related art, the first detection circuit and the second detection circuit each have advantages and disadvantages. In Embodiment 3, the disadvantages of each the first detection and the second detection circuit are respectively compensated by the advantages of the other. That is to say, it is a feature of Embodiment 3 that the microcontroller 3 uses either the first detection circuit 7 or the second detection circuit 8, depending on the operation state of the electronic device.

When the electronic device is in the standby state (V1=24V), then it is assumed that the interlock switch 4 is open. In this case, the microcontroller 3 detects the open state of the interlock switch 4 using the first detection circuit 7, that is, the first voltage division portion with the resistors 23 and 24. This first voltage division portion immediately lowers the output voltage V1=24V, which is the voltage on the load side, to the threshold voltage value of the digital input port PI1. Thus, the microcontroller 3 can detect the open state of the interlock switch 4 in a very short time.

Now, in the power saving state, in which the clock oscillation of the microcontroller 3 is stopped, the microcontroller 3 does not use the first detection circuit 7. Therefore, the digital input port PI1 does not necessarily have to be an interrupt input port. Moreover, the digital input port PI1 can also be replaced with an analog/digital input port AD. In a microcontroller 3 in which there is an unassigned analog/digital input port AD, this may lead to greater flexibility in assigning the ports.

As the microcontroller 3 controls the low-voltage power supply 2 and lowers the first output voltage V1 of the low-voltage power supply 2 until it is close to the second output voltage V2, the electronic device transitions from the standby state to the power saving state. It should be noted that the microcontroller 3 may also lower the clock oscillation frequency driving the controller or stop the clock oscillation operation driving the controller, when transitioning from the standby state to the power saving state.

Let us assume that the interlock switch 4 is open while the electronic device is in the power saving state (V1=3.3V). In this case, the microcontroller 3 detects the open state of the interlock switch 4 using a voltage converter including the second detection circuit 8, that is, the NPN transistor 27. As shown in FIG. 3B, the resistors 25 and 26 form a second voltage division portion dividing the voltage on the load side of the switch unit. Moreover, the NPN transistor 27 is an example of a semiconductor switching element including a first terminal, a second terminal and a third terminal. As shown in FIG. 3B, the voltage divided by the second voltage division portion is applied to the base, which is the first terminal. The second terminal, which is the emitter terminal, is coupled to ground. The output voltage (collector voltage)

from the third terminal, which is the collector terminal, is pulled up by the pull-up resistor 28, and input into the microcontroller 3.

In the power saving state, for example the driving system unit, the high-voltage power supply, and the laser scanner of the image forming apparatus do not operate. For this reason, even when the detection of the open state of the interlock switch 4 takes time, there is no harmful effect due to these components operating unchecked.

Moreover, in the power saving state, the output voltage is V1=3.3V. As illustrated in FIG. 4B, there is the advantage that, when V1=3.3V, the time until the voltage applied to the base of the NPN transistor 27 is lowered to about 0.7V is shorter than when V1=24V. The microcontroller 3 uses the second detection circuit 8 only in the power saving state in which the clock oscillation of the microcontroller 3 is stopped. For this reason, it is necessary that the detection signal that is output by the second detection circuit 8 is input into the interrupt input port PI2.

Thus, the circuit configuration of Embodiment 3, which uses both the first detection circuit 7 and the second detection circuit 8 functions regardless of whether the output voltage V1 is 24V or 3.3V. Furthermore, the detection signal that is output from the second detection circuit 8 can be processed digitally using the interrupt input port PI. That is to say, in the power saving state, the output voltage V1 is reduced to 3.3V, and it is possible to lower the clock oscillation frequency of the microcontroller 3 or stop the clock oscillation operation. Thus, the electronic device can be made a low power consumption electronic device.

With Embodiment 3, the open/closed state of the interlock switch 4 is detected using the first detection circuit 7, which detects the voltage on the load side of the interlock switch 4, and the second detection circuit 8, which detects the voltage on the load side of the interlock switch 4. Thus, it is possible to immediately detect the open/closed state of the interlock switch 4, independently from the value of the voltage applied to the interlock switch 4 and from the clock oscillation state of the microcontroller controlling the electronic device. It should be noted that it is possible to transition the electronic device from the power saving state to the standby state when the microcontroller 3 detects that the switch unit is open during the power saving state.

Figure 5:
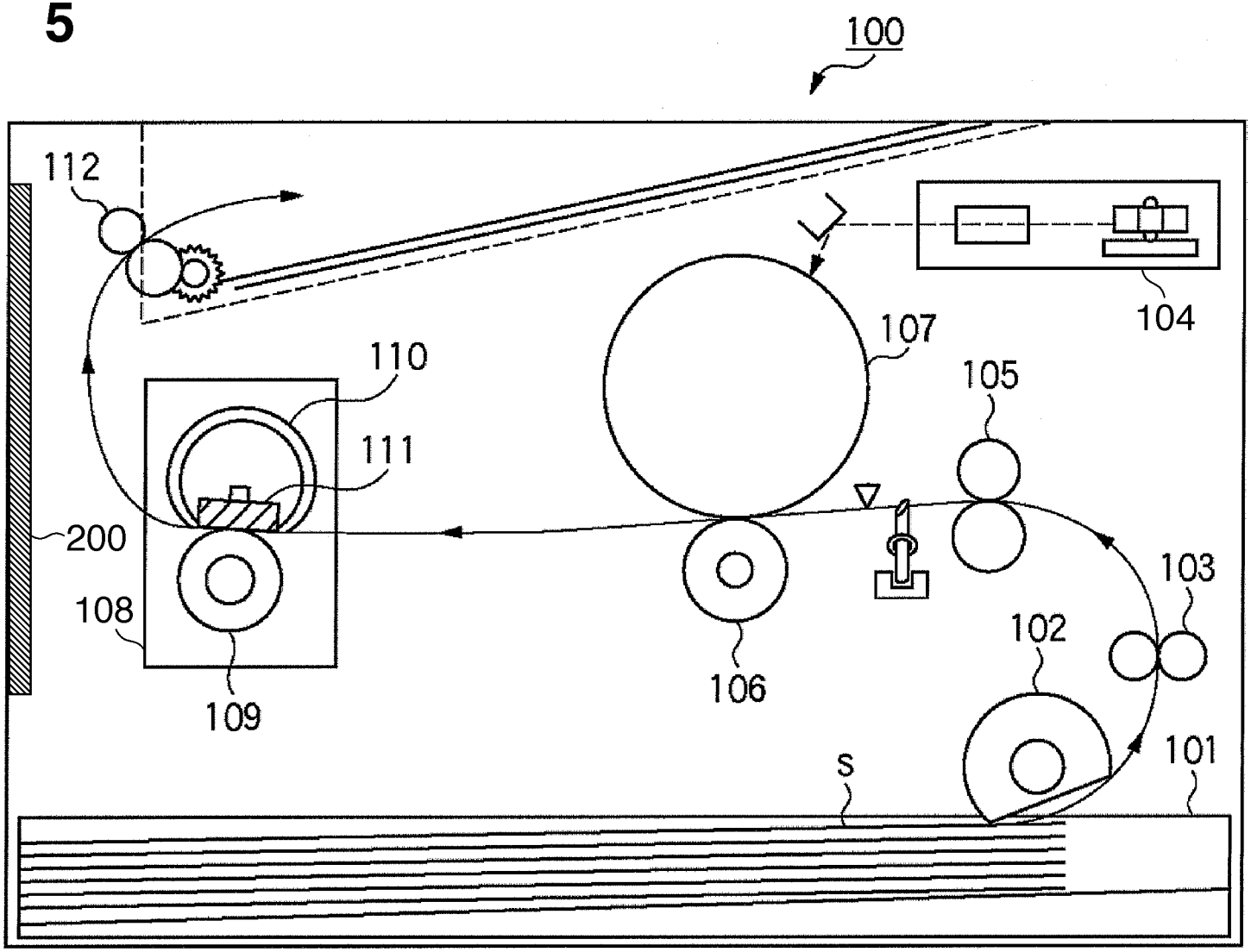
FIG. 5 is a diagram of an image forming apparatus, which is an example of an electronic device.

FIG. 5 is a figure showing an image forming apparatus, which is one example of an electronic device. A paper supply cassette 101 stores a multitude of recording media S. The recording media S may also be referred to as paper, sheets or transfer material. A paper supply roller 102 is driven by a paper supply solenoid, not shown in the drawings, the recording media S stacked in the paper supply cassette 110 are individualized into single recording media S, and supplied to conveying rollers 103. The conveying rollers 103 convey the recording medium S further downstream. Registration rollers 105 are one type of conveying rollers that convey the recording medium S. That is to say, the registration rollers 105 are used in order to adjust the timing at which the front edge of the recording medium S is conveyed to the image forming portion (transfer roller 106 and photosensitive drum 107). A laser scanner 104 forms a latent image by scanning the surface of the photosensitive drum 107, which has been uniformly charged, with laser light in accordance with an image signal. The latent image is developed with developer (for example toner) and turned into a developer image. The developer image is transferred by a transfer roller 106 from the photosensitive drum 107 to the recording medium S. A high-voltage transfer bias is applied by a high-voltage power supply device, which is an example of the load 5, to the transfer roller 106. Although not shown in the drawing, a high-voltage charge bias is applied from the high-voltage power supply also to a charge roller that uniformly charges the photosensitive drum 107, which is an example of an image bearing member.

In an image forming section, the recording medium S, to which the developer image is transferred, is conveyed to the fixing device 108. The fixing device 108 includes a pressure application roller 109, a fixing film 110 and a ceramic heater 111 for fixing the toner to the recording medium. After fixing by applying pressure, the recording medium S is ejected out of the apparatus by ejection roller 112.

The cover 200 is a cover for maintenance. By opening the cover 200, a maintenance operator can access the fixing device 108, the photosensitive drum 107 and the laser scanner 104. The above-described interlock switch 4 is arranged such that it is interlocked to the opening and closing of the cover 200. It should be noted that the ceramic heater 111, the motor and gears driving the photosensitive drum 107, the laser scanner 104 and the high-voltage power supply, are also examples of the load 5.

In the embodiments, an image forming apparatus was employed as an example of an electronic device, but other electronic devices are also possible. This is because the technical idea of the present invention can be applied to any electronic device having an open/close cover, where the opening or closing of the cover is detected from the opening or closing of a switch. Also the image forming method of the image forming apparatus is not limited to electrophotographic imaging and may also be electrostatic recording, magnetic recording, inkjet printing, sublimation, offset printing or the like. Also the image forming apparatus may be a printing apparatus, a printer, a copier, a multifunctional device or a facsimile.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2010-139943, filed Jun. 18, 2010 and 2011-107639, filed May 12, 2011, which are hereby incorporated by reference herein in their entirety.

What is claimed is:

1. An electronic device, comprising:

a switch unit that opens or closes interlocking with an opening or closing operation of a cover that the electronic device is provided with;

a voltage converter that generates a first output voltage and a second output voltage from a voltage that is supplied from a commercial alternate current power supply;

a load to which the first output voltage that is output from the voltage converter is supplied via the switch unit;

a controller to which the second output voltage that is output from the voltage converter is supplied and that controls the electronic device; and a potential difference detection unit that detects a potential difference between a power supply side and a load side of the switch unit;

wherein the controller determines a state of the switch unit based on the potential difference.

2. The electronic device according to claim 1, wherein the controller determines that the switch unit is open if the potential difference detected by the potential difference detection unit is greater than or equal to a predetermined value, and determines that the switch unit is closed if the potential difference is neither greater than nor equal to a predetermined value.

3. The electronic device according to claim 1, wherein the potential difference detection unit comprises:

a semiconductor switching element having a first terminal, a second terminal and a third terminal, the first terminal being coupled to the power supply side of the switch unit, the second terminal being coupled to the load side of the switch unit, and a predetermined output voltage occurring at the third terminal when the potential difference between the first terminal and the second terminal exceeds a predetermined value; and a voltage division circuit comprising a first resistor and a constant voltage diode that are coupled in series, the output voltage that is output from the third terminal being divided by the first resistor and the constant voltage diode, the divided voltage being output from the potential difference detection unit to an input port of the controller.

4. The electronic device according to claim 3, wherein the potential difference detection unit comprises a second resistor that is arranged in parallel to the constant voltage diode and the controller.

5. The electronic device according to claim 3, wherein the second terminal is coupled via a plurality of resistors to the load side of the switch unit.

6. The electronic device according to claim 1, wherein the potential difference detection unit comprises:

a first voltage division circuit that divides a voltage on the power supply side of the switch unit;

a second voltage division circuit that divides a voltage on the load side of the switch unit;

a comparison circuit that compares a divided voltage from the first voltage division circuit and a divided voltage from the second voltage division circuit, and outputs a result of the comparison to an input port of the controller as output from the potential difference detection unit.

7. The electronic device according to claim 1, wherein the controller transitions from a standby state to a power saving state by controlling the voltage converter to lower the first output voltage of the voltage converter to a value that is close to the second output voltage.

8. The electronic device according to claim 1, wherein the controller transitions from the standby state to the power saving state by lowering a clock oscillation frequency driving the controller.

9. The electronic device according to claim 1, wherein the controller transitions from the standby state to the power saving state by stopping a clock oscillation operation driving the controller.

10. The electronic device according to claim 1, wherein the controller transitions from the power saving state to the standby state when detecting that the switch unit is open while the electronic device is in the power saving state.

11. An electronic device, comprising:

a switch unit that opens or closes interlocking with an opening or closing operation of a cover that the electronic device is provided with;

a voltage converter that generates a first output voltage and a second output voltage from a voltage that is supplied from a commercial alternate current power supply;

a load to which the first output voltage that is output from the voltage converter is supplied via the switch unit;

a controller to which the second output voltage that is output from the voltage converter is supplied and that controls the electronic device;

a first detection unit that detects a voltage on the load side of the switch unit; and a second detection unit that detects the voltage on the load side of the switch unit;

wherein:

when the electronic device is in a first operating state, the controller determines a state of the switch unit based on a result of the first detection unit, when the electronic device is in a second operating state that a power consumption of the device is lower than that in the first operating state, the controller determines the state of the switch unit based on a result of the second detection unit.

12. The electronic device according to claim 11, wherein the first operating state is a standby state, the controller determines that the switch unit is open if the voltage detected by the first detection unit is at least a predetermined voltage, and determines that the switch unit is closed if the voltage detected by the first detection unit is not at least a predetermined voltage;

wherein the second operating state is a power saving state, the controller determines that the switch unit is open if the voltage detected by the second detection unit is at least a predetermined voltage, and determines that the switch unit is closed if the voltage detected by the second detection unit is not at least a predetermined voltage.

13. The electronic device according to claim 11, wherein the first detection unit includes a first voltage division circuit that divides the voltage on the load side of the switch unit.

14. The electronic device according to claim 11, wherein the second detection unit comprises:

a second voltage division circuit that divides the voltage on the load side of the switch unit; and a semiconductor switching element having a first terminal, a second terminal and a third terminal, a divided voltage from the second voltage division circuit being applied to the first terminal, the second terminal being coupled to ground, an output voltage from the third terminal being pulled up by a pull-up resistor, and the pulled-up output voltage being output to the controller.

15. The electronic device according to claim 12, wherein the controller transitions from the standby state to the power saving state by controlling the voltage converter to lower the first output voltage of the voltage converter to a value that is close to the second output voltage.

16. The electronic device according to claim 12, wherein the controller transitions from the standby state to the power saving state by lowering a clock oscillation frequency driving the controller.

17. The electronic device according to claim 12, wherein the controller transitions from the standby state to the power saving state by stopping a clock oscillation operation driving the controller.

18. The electronic device according to claim 12, wherein the controller transitions from the power saving state to the standby state when detecting that the switch unit is open while the electronic device is in the power saving state.

19. An image forming apparatus, comprising:

a switch unit that opens or closes interlocking with an opening or closing operation of a cover that the image forming apparatus is provided with;

a voltage converter that generates a first output voltage and a second output voltage with different voltage values from a voltage that is supplied from a commercial alternate current power supply;

a load to which the first output voltage that is output from the voltage converter is supplied via the switch unit;

a controller to which the second output voltage that is output from the voltage converter is supplied and that controls the image forming apparatus; and a potential difference detection unit that detects a potential difference between a power supply side and a load side of the switch unit;

wherein the controller determines a state of the switch unit based on the potential difference.

20. The image forming apparatus according to claim 19, wherein the controller determines that the switch unit is open if the potential difference detected by the potential difference detection unit is greater than or equal to a predetermined value, and determines that the switch unit is closed if the potential difference is neither greater than nor equal to a predetermined value.

21. An image forming apparatus, comprising:

a switch unit that opens or closes interlocking with an opening or closing operation of a cover that the image forming apparatus is provided with;

a voltage converter that generates a first output voltage and a second output voltage with different voltage values from a voltage that is supplied from a commercial alternate current power supply;

a load to which the first output voltage that is output from the voltage converter is supplied via the switch unit;

a controller to which the second output voltage that is output from the voltage converter is supplied and that controls the image forming apparatus; and a first detection unit that detects a voltage on the load side of the switch unit; and a second detection unit that detects a voltage on the load side of the switch unit;

wherein:

when the electronic device is in a first operating state, the controller determines a state of the switch unit based on a result of the first detection unit, when the electronic device is in a second operating state that a power consumption of the device is lower than that in the first operating state, the controller determines the state of the switch unit based on a result of the second detection unit.

22. The image forming apparatus according to claim 21, wherein the first operating state is a standby state, the controller determines that the switch unit is open if the voltage detected by the first detection unit is greater than or equal to a predetermined value, and determines that the switch unit is closed if the voltage detected by the first detection unit is neither greater than nor equal to a predetermined value;

wherein the first operating state is a power saving state, the controller determines that the switch unit is open if the voltage detected by the second detection unit is greater than or equal to a predetermined value, and determines that the switch unit is closed if the voltage detected by the second detection unit is neither greater than nor equal to a predetermined value.

* * * * *